United States Patent [19]

Krogstad et al.

[11] 4,078,768

[45] Mar. 14, 1978

[54] HAULING-IN A ROPE AND CHAIN LINE

[75] Inventors: Ivar Krogstad, Arendal; Harry Sandøy, Kolbjornsvik; Kåre Sethre, Arendal, all of Norway

[73] Assignee: A/S Pusnes Mekaniske Verksted, Arendal, Norway

[21] Appl. No.: 737,029

[22] Filed: Oct. 29, 1976

[51] Int. Cl.[2] ..... B66D 1/76

[52] U.S. Cl. ..... 254/175.7; 226/118; 114/230

[58] Field of Search ..... 254/175.7, 175.5, 135 R, 254/190 B, 173 A, 175.3; 226/118; 59/93; 114/230; 242/47.5

[56] References Cited

U.S. PATENT DOCUMENTS

| | | | |
|---|---|---|---|
| 2,948,483 | 8/1960 | Petersen | 254/175.7 |
| 3,191,837 | 6/1965 | Cohen et al. | 226/118 |
| 3,912,228 | 10/1975 | Petty et al. | 254/175.7 |
| 3,977,181 | 8/1976 | Odegard et al. | 59/93 |
| 3,985,093 | 10/1976 | Eidem | 59/93 |

*Primary Examiner*—Trygve M. Blix
*Assistant Examiner*—Kenneth Noland
*Attorney, Agent, or Firm*—Watson, Cole, Grindle & Watson

[57] ABSTRACT

In a method of hauling-in a rope and a chain interconnected by a coupling link, using a winch for the rope and a wildcat for the chain, the rope is hauled-in on the winch until the coupling link has moved past the wildcat, whereafter the chain is locked, and the winch is reversed to dump the chain on the wildcat and make it form a sling on the side leading to the chain box, whereafter the wildcat is started and the chain is unlocked.

5 Claims, 2 Drawing Figures

HAULING-IN A ROPE AND CHAIN LINE

BACKGROUND OF THE INVENTION

This invention relates to a method of handling an anchoring or mooring line comprising a rope, a chain, and a coupling link connecting the rope and the chain, in the process of hauling the line in.

An important use of a combined line of the type described is for the anchoring or mooring of offshore drilling rigs or vessels, particularly semi-submersible drilling rigs operating at moderate or great sea depths.

Though the advantages of this type of mooring line are generally recognized by experts — the chain part of the line permitting vertical movement of the drilling rig or vessel under the influence of even high waves without over-stressing of the line, the rope part limiting horizontal displacement — it is still more usual to employ either a chain alone or a rope alone. The reason for this is the difficulties encountered in passing the coupling link through the required bends of the path in which the line must be guided onboard the rig, and in changing over from hauling in rope by means of a winch drum or the like to hauling in chain by means of a wildcat or the like. It has been attempted to overcome these difficulties by stowing the chain on a service vessel from which the chain is connected to the rope outside the drilling rig or main vessel when the rope is paid out from the latter, but this method is time consuming, expensive and dangerous.

The dismounting of the connection between the wire rope and the chain may also take place onboard. The line with the coupling link must then first pass around a fairlead, and when the upper end of the chain has arrived at a sutiable height, the haul-in is stopped. The chain is now locked by means of a chain stop or locking lever, whereafter the winch drum on which the rope is wound can be released, and the coupling link can be disconnected. The chain must then be connected to a length of chain, which is preferably fastened within the chain box, before haul-in can be continued, now by means of the wildcat.

While these operations may be performed without difficulty in nice weather, when the chain is new and the chain load is moderate, serious problems may arise at low temperatures, in heavy weather, if the coupling link has been subjected to deformation or corrosion, or if the load on the chain is heavy.

SUMMARY OF THE INVENTION

It is an object of the invention to avoid these time consuming, complicated and dangerous operations. Moreover, even if a coupling link is used, which minimizes the transfer of bending stresses to the rope at the point of connection of the rope to the coupling link, such as the coupling link disclosed in U.S. Pat. No. 3,977,181, it will usually be necessary to increase the dimensions of sheaves or fairleads around which the coupling link is to pass as compared to sheaves or fairleads for only a chain or only a wire rope.

It is therefore desirable to keep the number of fairleads or sheaves for guiding the wire rope and the coupling link between the wire rope and the chain as low as possible.

It is a further object of the invention to arrange the haul-in procedure in such a manner that a minimum number of guiding sheaves or fairleads is required.

For carrying out the method according to the invention, an equipment composed of conventional elements is used, viz. a rope winch for hauling-in the rope, a wildcat for hauling-in the chain, said the wildcat having a substantially horizontal axis of rotation, and a chain box for receiving the hauled-in chain. The method according to the invention comprises the following steps:

a. hauling-in the line by means of the rope winch until the coupling link has passed by the wildcat,
b. locking the chain in a zone thereof that has not passed by the wildcat, thereby preventing transfer of the chain force to the rope,
c. paying out rope from the rope winch to lower the chain into contact with the wildcat and to make it form a depending sling on the side thereof leading to the chain box, and then stopping the rope winch,
d. starting the wildcat in the haul-in direction to make it engage the chain and take over the tension therein,
e. releasing the chain from the locking that was made in step (b),
f. hauling-in the chain by means of the wildcat. In this way the necessity of disconnecting the rope and the chain for the purposes of haul-in is avoided.

Preferably, between steps (c) and (d), the couplng link is parked in a position such that it cannot get in the way of chain running off the wildcat during haul-in. For the parking of the coupling link a suitable holder may be provided.

If the rope winch is in the form of a winch drum with a spooling gear, it is proposed, according to an embodiment of the invention, to liberate the spooling gear from the normal spooling function during the last part of step (a) and then to use the spooling gear for guiding the rope in such a manner that at the end of step (a) the chain is present directly above the wildcat, i.e. in the median vertical plane thereof.

DESCRIPTION OF THE PREFERRED EMBODIMENT

Figure 1:
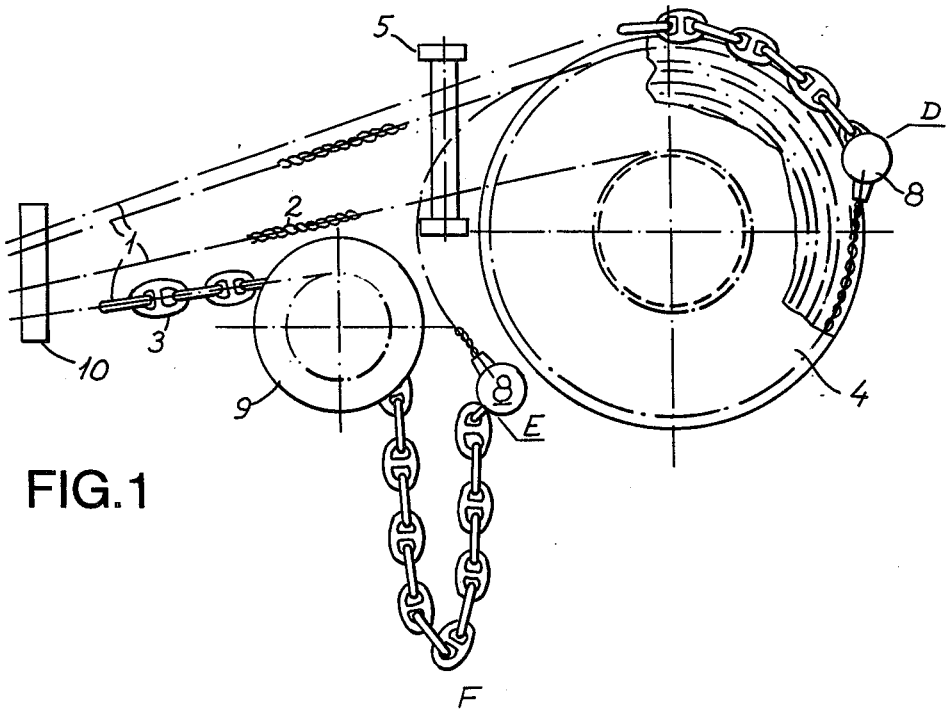
FIG. 1 illustrates diagrammatically the method of the invention and one form of equipment for carrying out the method, in side view.

The anchoring or mooring line 1, which consists of a wire rope 2 and a chain 3 connected with each other by means of a coupling link, is guided around a sheave or fairlead (not shown in the drawing) to a rope winch 4 which in the case illustrated is a winch drum with a spooling gear 5. The spooling gear 5 is constructed with two vertical rollers 6 and 7, which are normally automatically controlled to perform the spooling function, but can be liberated for manual control.

During haul-in of the rope 2, the automatic spooling function of the rollers 6 and 7 is utilized. In good time before the connecting link 8 between the rope 2 and the chain 3 approaches the spooling device 5, the automatic spooling function is stopped. The vertial rollers 6 and 7 of the spooling gear 5 are now manually moved in such a manner that the rope 2 is displaced from the position A, in which it happens to be at the moment, to position B, i.e. such that the line 1 will be present directly above the wildcat 9 when the coupling link 8 has almost proceeded to the spooling gear 5.

Figure 2:
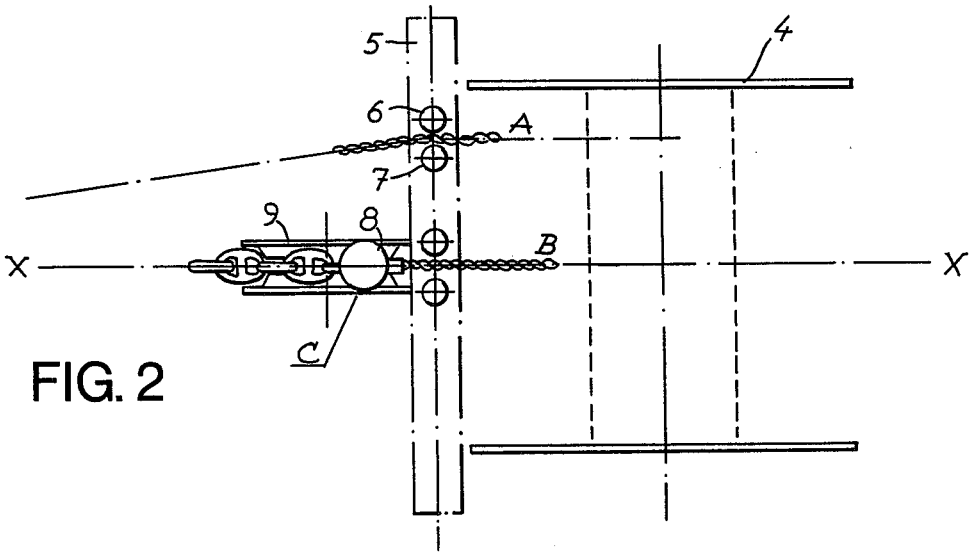
FIG. 2 is the same in top view.

To permit the coupling link 8 and the chain 3 to move past the spooling gear 5, the vertical rollers 6 and 7 of the illustrated embodiment must be set free. Position C represents the ideal location of the coupling link 8 after the rollers 6 and 7 have been liberated. In order to obtain this, that one of the rollers, which is closer to the median vertical plane X—X of the wildcat — in the position illustrated the roller 7 — is moved away from the chain to a position on the side of the plane X—X opposite to that on which the rope is being hauled- in the illustration of FIG. 2 this means below the line X—X. The other one of the rollers — in the example the roller 6 — is now used for pressing the rope towards the plane X—X to position the rope in this plane at the end of the haul-in. If necessary, the rope 2 may be pressed over to the opposite side of the vertical plane X—X during the last part of the haul-in before the rollers 6 and 7 are liberated. The rope 2 is now further hauled-in by means of the winch drum 4 until the coupling link 8 arrives approximately in position D. Thereafter, the chain 3 is locked, e.g. by means of a stop member 10 between the fairlead and the wildcat 9 so that the rope 2 and the chain 3 may be releaved of tension. Now, a length of line 1 is paid out by means of the winch drum 4 so as to make the chain 3 contact the wildcat and form a sling in position F under the wildcat 9. The coupling link 8 is parked in position E by means of a suitable holder so that the chain 3 may proceed without hindrance on its way to the chain box. The position E may be located outside the median vertical plane X—X of the wildcat.

Now the wildcat 9 is started for rotation. When the wildcat 9 has taken over the whole tension in the chain 3, the chain stop 10 is released and haul-in of the chain 3 can take place in the usual manner. During pay-out, the procedure described is repeated substantially in the reverse order. When the pay-out of the chain is approaching its end, the rotation of the wildcat 9 must take place slowly, and it is stopped by means of the usual brake to come to a halt when the chain 3 forms a sling as shown in the figure, position F. By locking the chain 3, the tension is taken over by the stop member 10 and the brake of the wildcat may be disengaged. By hauling-in the slack of the line 1 by means of the winch drum 4 so that the coupling link 8 arrives approximately in position D the chain 3 will be lifted from the wildcat 9. When the winch drum 4 has taken over the whole load, the chain stop 10 is released, and the further pay-out is controlled by means of the rope winch 4.

We claim:

1. A method of handling an anchoring or mooring line comprising a rope, a chain, and a coupling link connecting said rope and said chain, in the process of hauling-in, using equipment comprising a rope winch for hauling-in said rope, a wildcat for hauling-in said chain, said wildcat having a substantially horizontal axis of rotation and being placed laterally of said rope winch on the haul-in side thereof, and a chain box for receiving the hauled-in chain, said method comprising the steps of hauling-in the line by means of the rope winch in a path above the top of the wildcat until the coupling link has passed by the wildcat; guiding the chain to a position vertically above the wildcat; locking the chain at a point thereof on the side of the wildcat remote from the rope winch, thereby preventing transfer of the chain force to the rope; paying out rope from the rope winch to lower the chain into contact with the wildcat and to make it depend towards the chain box between the wildcat and the rope winch in the form of a loose doubled up sling; stopping the rope winch; starting the wildcat in the haul-in direction to make it engage the chain and take over the tension therein; releasing the chain from the locking previously mentioned; and hauling-in the chain by means of the wildcat, while keeping the rope winch stationary.

2. A method as in claim 1, characterized in that after a length of rope has been paid out from the rope winch and before starting the wildcat in the haul-in direction the coupling link is positioned such that it cannot get in the way of the chain running off the wildcat during haul-in.

3. A method of handling an anchoring or mooring line comprising a rope, a chain, and a coupling link connecting said rope and said chain, in the process of hauling-in, using equipment comprising a rope winch for hauling-in said rope, said rope winch being in the form of a winch drum with a spooling gear, a wildcat for hauling in said chain, said wildcat having a substantially horizontal axis of rotation and being placed laterally of said rope winch on the haul-in side thereof, and a chain box for receiving the hauled-in chain, said method comprising the steps of hauling-in the line by means of the rope winch in a path above the top of the wildcat until the coupling link has passed by the wildcat; liberating the spooling gear from the normal spooling function during the last part of the hauling-in step and using the spooling gear thus liberated for guiding the rope in such a manner that at the end of the hauling-in step the chain is present directly above the wildcat; locking the chain at a point thereof on the side of the wildcat remote from the rope winch, thereby preventing transfer of the chain force to the rope; paying out rope from the rope winch to lower the chain into contact with the wildcat and to make it depend towards the chain box between the wildcat and the rope winch in the form of a loose doubled up sling; stopping the rope winch; starting the wildcat in the haul-in direction to make it engage the chain and take over the tension therein; releasing the chain from said locked position; and hauling-in the chain by means of the wildcat, while keeping the rope winch stationary.

4. A method as in claim 3, where the winch drum is located near the wildcat, and the spooling gear is of the type comprising two vertical rollers which, upon liberation from the normal spooling function, can be moved independently of one another, characterized in that upon liberation of the vertical rollers from their normal spooling function that one of these rollers which is closer to the median vertical plane of the wildcat is moved away from the chain to a position on the side of said plane opposite to that on which the rope is being hauled-in at the moment, whereafter the other one of said rollers is used for pressing the rope towards said plane to position the rope therein towards the end of step (a), whereafter said other one of said rollers is retracted or set free to permit the coupling link to pass between the vertical rollers of the spooling gear and, if required, onto the winch drum in the final stage of step (a).

5. A method of handling an anchoring or mooring line comprising a rope, a chain, and a coupling link connecting said rope and said chain, in the process of hauling-in, using equipment comprising a rope winch for hauling-in said rope, said rope winch being in the form of a winch drum with a spooling gear of the type comprising two vertical rollers which upon liberation from the normal spooling function can be moved independently of one another, a wildcat for hauling-in said chain, said wildcat having a substantially horizontal axis of rotation and being placed laterally of said rope winch on the haul-in side thereof, and a chain box for receiving the hauled-in chain, said method comprising the steps of hauling-in the line by means of the rope winch in a path above the top of the wildcat until the coupling link has passed by the wildcat; liberating the vertical rollers from their normal spooling function towards the end of the hauling-in step; moving the one of these rollers which is closer to the median vertical plane of the wildcat away from the chain to a position on the side of said plane opposite to that on which the rope is being hauled-in at the moment; pressing the rope towards said plane using the other one of said rollers to position the rope therein towards the end of the hauling-in step; retracting said other one of said rollers to permit the coupling link to pass between the vertical rollers of the spooling gear; locking the chain at a point thereof on the side of the wildcat remote from the rope winch, thereby preventing transfer of the chain force to the rope; paying out rope from the rope winch to lower the chain into contact with the wildcat; continuing said paying out step and at the same time using one of the vertical rollers for guiding the rope in such a manner as to move the coupling link to a parking position outside the median vertical plane of the wildcat; continuing further said paying out step to make the chain depend towards the chain box between the wildcat and the rope winch in the form of a loose doubled up sling; stopping the rope winch; starting the wildcat in the haul-in direction to make it engage the chain and take over the tension therein; releasing the chain from said locked position; and hauling-in the chain by means of the wildcat, while keeping the rope winch stationary.

* * * * *